US006773336B2

(12) United States Patent
Bootle

(10) Patent No.: US 6,773,336 B2
(45) Date of Patent: Aug. 10, 2004

(54) METHOD OF FORMING A RECESS IN A BODY

(75) Inventor: Geoffrey David Bootle, Kent (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/303,234

(22) Filed: Nov. 25, 2002

(65) Prior Publication Data

US 2003/0109203 A1 Jun. 12, 2003

(30) Foreign Application Priority Data

Nov. 29, 2001 (GB) ..... 0128925

(51) Int. Cl.[7] ..... B24B 1/00
(52) U.S. Cl. ..... 451/51; 451/541
(58) Field of Search ..... 451/51, 541, 544, 451/545, 546, 547, 178, 231, 244, 245, 28

(56) References Cited

U.S. PATENT DOCUMENTS

| | | | | |
|---|---|---|---|---|
| 2,384,800 A | | 9/1945 | Cox | |
| 2,772,524 A | * | 12/1956 | Kopczynski | |
| 3,545,336 A | | 12/1970 | Savko | |
| 4,170,975 A | | 10/1979 | Wessel et al. | |
| 5,853,316 A | | 12/1998 | Kern et al. | |
| 6,358,133 B1 | * | 3/2002 | Cesena et al. | 451/450 |

FOREIGN PATENT DOCUMENTS

| | | |
|---|---|---|
| DE | 871709 | 3/1953 |
| EP | 397955 | 11/1990 |
| FR | 923640 | 7/1947 |
| FR | 7206862 | 2/1972 |
| GB | 2157597 | 4/1984 |

OTHER PUBLICATIONS

"Nuten Schleifen Statt Frasen" Werkstatt und Betrieb, Carl Hanser Varlag. Munchen, DE, vol. 122, Nr. 9, pp. 733 XP000084119 ISSN: 0043–2792.

* cited by examiner

*Primary Examiner*—Eileen P. Morgan
(74) *Attorney, Agent, or Firm*—David P. Wood

(57) ABSTRACT

A method of forming a recess in a body having a surface of substantially cylindrical form utilises a grinding wheel having a first axis in the form of a drive axis, and a circumferential surface concave to a second axis that is substantially orthogonal to the first axis. The grinding wheel also includes first and second opposing radial surfaces of substantially planar form. At least a portion of the circumferential surface of the grinding wheel is engaged with an outer surface of the body and the grinding wheel is rotated about the drive axis to cause a region of the body to be ground, thereby to define a recess in the body having a periphery including at least two substantially square corners and at least one pair of substantially parallel facing edges. The method is conveniently used to provide an opening or port of at least partially square or rectangular form in a cylindrical body such as a metering valve.

16 Claims, 5 Drawing Sheets

METHOD OF FORMING A RECESS IN A BODY

FIELD OF THE INVENTION

The invention relates to a method of forming a recess in a body. In particular, but not exclusively, the invention relates to a method of forming a recess in a metal body to define an opening having an outer periphery of at least partially square or rectangular form.

BACKGROUND OF THE INVENTION

In a metering valve arrangement of the type used to control fuelling of a compression ignition internal combustion engine, a metering valve member is angularly adjustable within a bore of a metering valve sleeve to vary the degree of overlap between a recess or channel provided in the metering valve member and an outlet port provided in the sleeve so as to vary the rate of flow of fuel to the engine. The metering valve member is of generally solid, cylindrical form except for the provision of the recess. It is known that the sensitivity of the metering valve arrangement is improved if both the outer periphery of the recess in the metering valve member and that of the outlet port in the sleeve with which the recess cooperates are of substantially square or rectangular form.

It has been proposed to use a spark erosion technique using an Electric Discharge Machine (EDM) to form ports or openings of square or rectangular form in the above mentioned components. However, such techniques are time consuming and the manufacturing cost per item is high, and so they are not suitable for large scale manufacture of such items. It has also been proposed to use injection moulding techniques to form such square or rectangular ports but, again, the associated manufacturing costs are prohibitive.

The present invention is aimed at one or more of the problems identified above.

SUMMARY OF THE INVENTION AND ADVANTAGES

According to the present invention, there is provided a method of forming a recess in a body having a cylindrical surface, the method comprising:

- providing a grinding wheel having a first axis, a circumferential surface concave to a second axis that is substantially orthogonal to the first axis and first and second opposing radial surfaces of substantially planar form,
- engaging at least a portion of the circumferential surface of the grinding wheel with an outer surface of the body, and
- rotating the grinding wheel and the body relative to one another about the first axis to cause a region of the body to be ground by said wheel, thereby to define a recess in the body, having a periphery at the cylindrical surface thereof, which includes at least two substantially square corners and at least one pair of substantially parallel facing edges.

For the purpose of this specification, the phrase 'grinding' shall be taken to refer to any process by which material is ground, milled or otherwise removed from a body through engagement between a rotatable grinding element and the body, and shall therefore be taken to include processes commonly referred to as milling processes in which a toothed milling wheel or disc is brought into engagement with the body and relative rotational movement between the milling wheel and the body causes removal of a portion of the body.

In a preferred embodiment, the first axis forms a drive axis, and the method includes the step of rotating the grinding wheel about the first axis to provide said relative rotation between the grinding wheel and the body. As an alternative, or in addition, the body itself may be rotated or otherwise moved relative to the wheel to provide said relative rotation.

In one embodiment of the invention, the body may be of substantially solid form and may, for example, take the form of a metering valve member for a metering valve arrangement, having a substantially cylindrical outer surface.

If the method is used to provided a recess in a metering valve member having a substantially cylindrical outer surface, an end region of the metering valve member may be ground such that the recess extends to an end surface of the metering valve member and has an outer periphery at the outer surface of the metering valve member having only two square corners.

In an alternative embodiment of the invention, the body may be provided with an internal bore defining a tubular wall having a substantially cylindrical internal surface, and the method may comprise the step of rotating the grinding wheel and the body relative to one another until the recess extends through the tubular wall to define an opening having a periphery at the internal surface of the wall that includes at least two substantially square corners. For example, the body may take the form of a metering valve sleeve for a metering valve member.

The method may be used to provide a recess in a region of the body intermediate opposing end regions of the body such that the recess has a periphery at the internal surface of the tubular wall having four substantially square corners, and two pairs of substantially parallel facing edges, such that the periphery is substantially square or rectangular in shape.

In one preferred embodiment, the circumferential surface of the grinding wheel is shaped such that the outer periphery of the opening defined in the tubular wall has a periphery at the internal surface of the wall having four substantially square corners, and two pairs of substantially parallel facing edges.

It has been found that the provision of cooperable openings of square or rectangular form in the valve member and the sleeve components of a metering valve arrangement improves the sensitivity of the valve.

The body to be ground extends along a further axis, the method preferably comprising the step of rotating the grinding wheel about a first axis which is substantially perpendicular to the further axis.

If required, the method may include the further step of punching or otherwise finishing the periphery to remove any slight anomalies at the corners if they are not quite square.

The present invention provides a convenient method of forming a square or rectangular recess or opening in a metering valve component, and is suitable for large scale component production. In general the method may be utilised for the formation of recesses or openings of square or rectangular form in any component formed from metal, or another material suitable for grinding.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
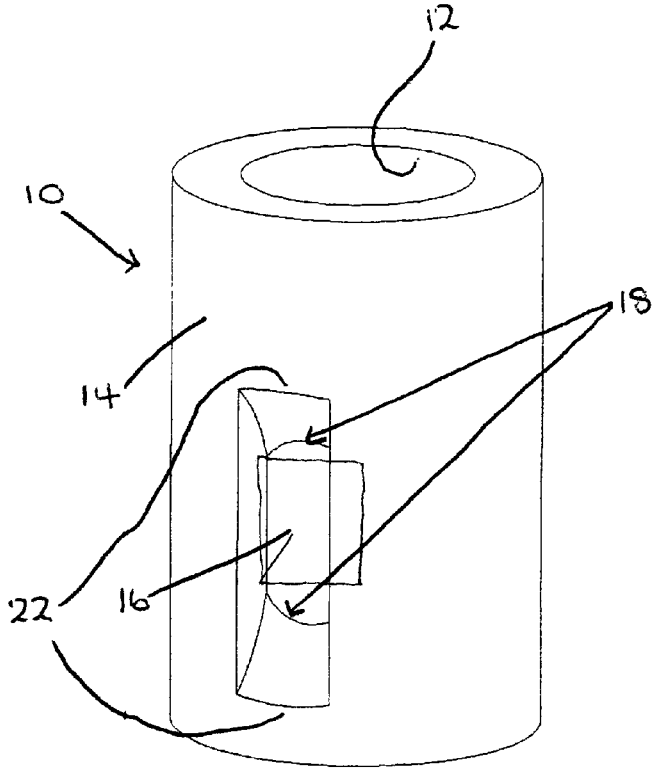
FIGURE 1 PRIOR ART
FIG. 1 is a perspective view of a metering valve sleeve provided with an opening which, at an internal bore of the sleeve, has two facing peripheral edges of convex form.

FIG. 1 shows a sleeve member 10 of the type used as a metering valve sleeve in a metering valve arrangement for controlling the rate of flow of fuel to an engine. Typically, the metering valve arrangement is operable under the control of a governor to vary the fuelling level of the engine in response to variations in engine load. The metering valve sleeve 10 is provided with an internal through bore 12 to define a tubular wall 14 having internal and external cylindrical surfaces, and in which an opening 16 is provided to define an outlet port for a fluid flow. The opening 16 in the tubular wall 14 is conveniently formed using the conventional technique of rotating a grinding disc or milling wheel (not shown in FIG. 1) such that the disc impacts the cylindrical outer surface of the sleeve 10 and grinds away a region of the sleeve to define the opening 16. Using this technique, the opening 16 has, at the internal surface 14 or the wall of the sleeve 10, a periphery having upper and lower edges 18 that are convex to the longitudinal axis of the opening 16. The periphery of the opening 16 at the outer surface of the tubular wall 14 also has a periphery having upper and lower edges 22 that are convex to the longitudinal axis of the opening 16. The opening 16 defines an outlet port through which fuel flows to the engine when the metering valve arrangement is in use.

Figure 2:
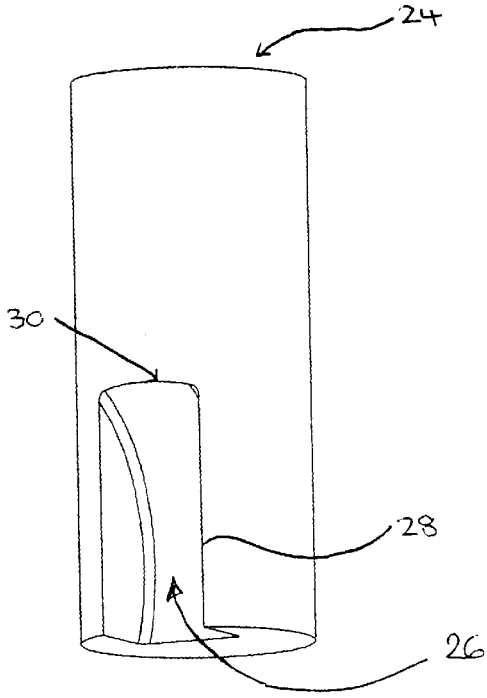
FIGURE 2 PRIOR ART
FIG. 2 is a perspective view of a metering valve member provided with a recess defining an opening having an upper peripheral edge of concave form.

FIG. 2 shows a metering valve member that, in use, is inserted into the internal bore 12 of the metering valve sleeve 10. The metering valve member 24 is provided with a recess or groove 26 which, when in use, cooperates with the opening 16 provided in the metering valve sleeve 10 to vary the rate at which fuel is able to flow through the metering valve arrangement, depending on the angular position of the metering valve member 24 within the sleeve 10. By varying the angular position of the metering valve member 24 within the bore 12, the degree of overlap between the recess 26 and the opening 16 can be varied to vary the fuel flow rate through the valve. As can be seen in FIG. 2, the recess 26 has an outer periphery 28 at the outer surface of the metering valve member 24 having an upper edge 30 concave to the longitudinal axis of the recess 26. It is known to form the recess 26 in the metering valve member 24 using the same technique as described previously for the opening 16 in the sleeve 10, whereby a grinding wheel impacts the cylindrical outer surface of the metering valve member 24 to remove a region of the member 24 to define the recess 26.

It has been found that advantages are obtained if the opening 16 in the metering valve sleeve 10 at the internal bore 12 has an outer periphery 28 of generally square or rectangular form and, in addition, if the outer periphery of the opening defined by the recess 26 in the metering valve member 24, which cooperates with the opening 16, is of partially square or rectangular form. Using the aforementioned technique for forming the opening 16 in the sleeve member 10 and the recess 26 in the metering valve member 24, it is not possible to produce an opening or recess having a periphery of this shape.

Figure 3:
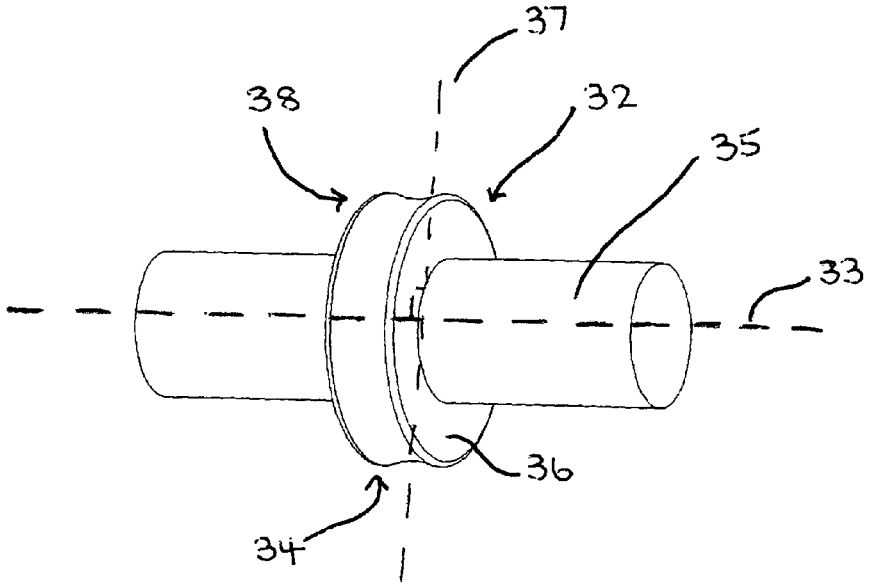
FIG. 3 is a perspective view of a rotatable grinding wheel of the type used in the method of the present invention.
Figure 6:
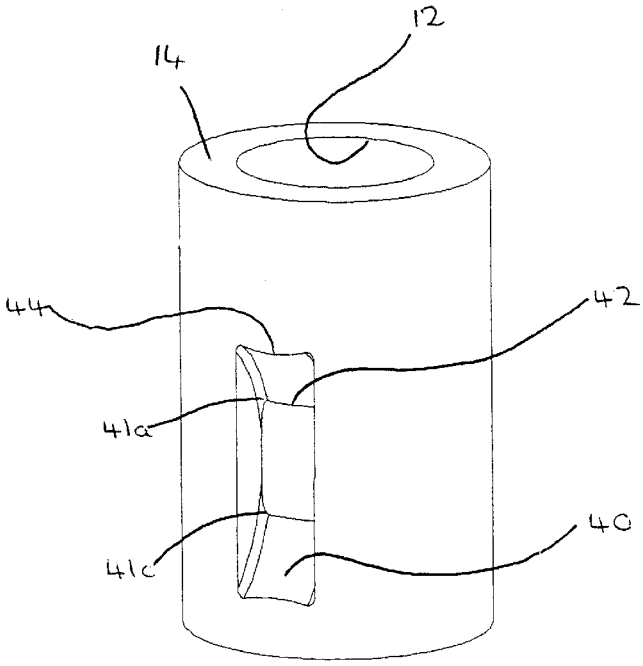
FIG. 6 is a perspective view of the metering valve sleeve in FIG. 5; and, FIG. 7 is a front view of a metering valve member provided with an opening having a periphery of rectangular form.
Figure 4:
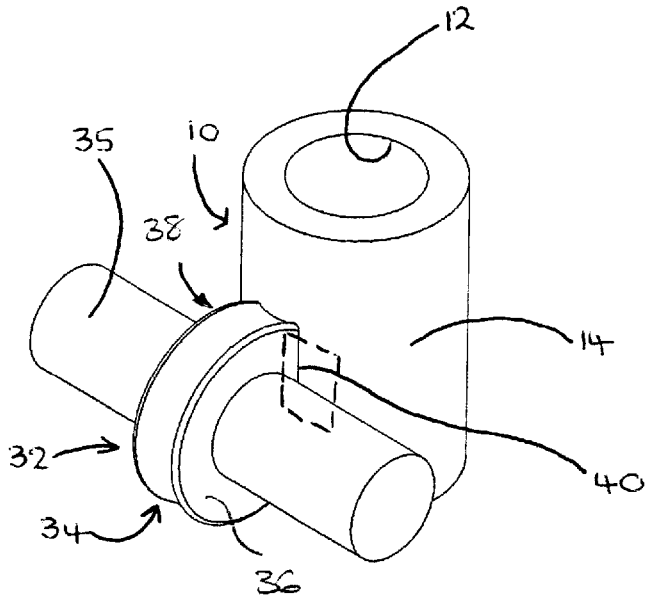
FIG. 4 is a perspective view of the grinding wheel in FIG. 3 when in use in the method of the present invention.
Figure 5:
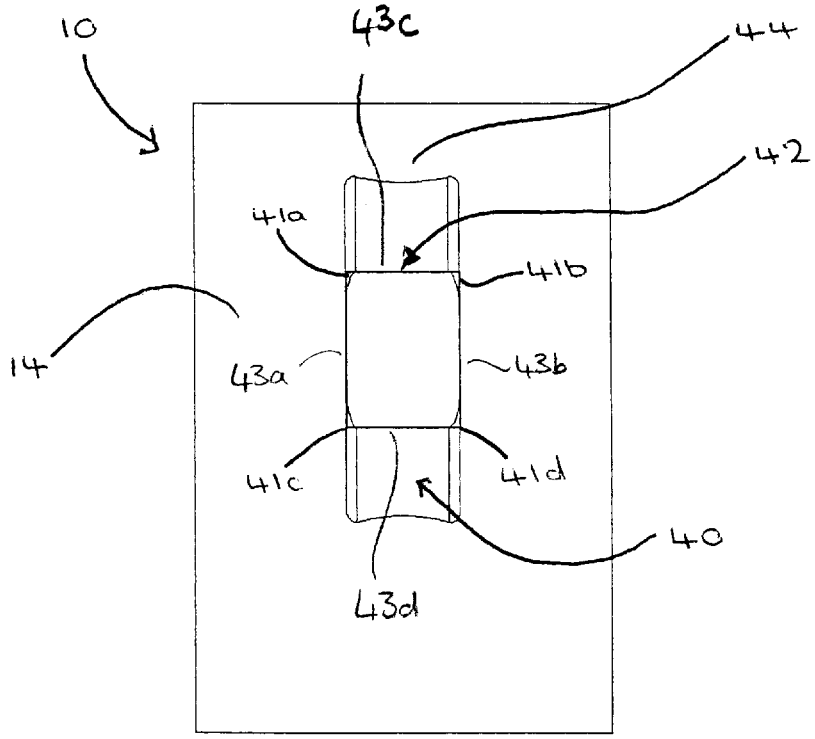
FIG. 5 is a front view of a metering valve sleeve provided with an opening of rectangular form.

Referring to FIGS. 3 and 4, the present invention overcomes this problem by mounting a grinding wheel 32 upon a drive shaft 35 having a drive axis 33, and providing the grinding wheel 32 with an outer circumferential surface 34 concave to a diametrical axis 37 of the wheel 32, the axis 37 being substantially orthogonal to the drive axis 33. The wheel 32 also includes and first and second opposing radial surfaces 36, 38 respectively of substantially planar form, which face along the drive axis 33 in opposite directions. FIG. 4 shows the grinding wheel 32 when it is engaged with the cylindrical outer surface of the sleeve member 10 during the grinding process. The drive shaft. 35 is rotated to rotate the grinding wheel 32, thereby causing a region of the sleeve 10 to be ground. The grinding process is continued until the grinding wheel 32 forms a recess in the sleeve member 10 that extends fully through the tubular wall 14 to define an opening 40 therein. As shown in FIGS. 5 and 6, the peripheral surface 34 of the grinding wheel 32 is shaped such that an outer periphery 42 of the opening 40 formed at the internal surface of the tubular wall 14 of the sleeve 10 is of substantially rectangular form, the periphery 42 of the opening 40 having four substantially square corners 41*a*, 41*b*, 41*c*, 41*d*. Facing pairs of edges 43*a*, 43*b* and 43*c*, 43*d* of the periphery 42 are formed substantially parallel to one another by virtue of the planar radial surfaces 36, 38 of the disc 32.

The metering valve sleeve 10 usually takes the form of a tubular sleeve, having external and internal surfaces of substantially cylindrical form. It will be appreciated, however, that the shape of the outer surface of the sleeve 10 does not matter, and that providing the internal surface of the sleeve wall 14 is cylindrical, appropriate shaping of the grinding wheel, as described previously, will produce the required profile for the opening at the internal surface of the sleeve 10.

Figure 7:
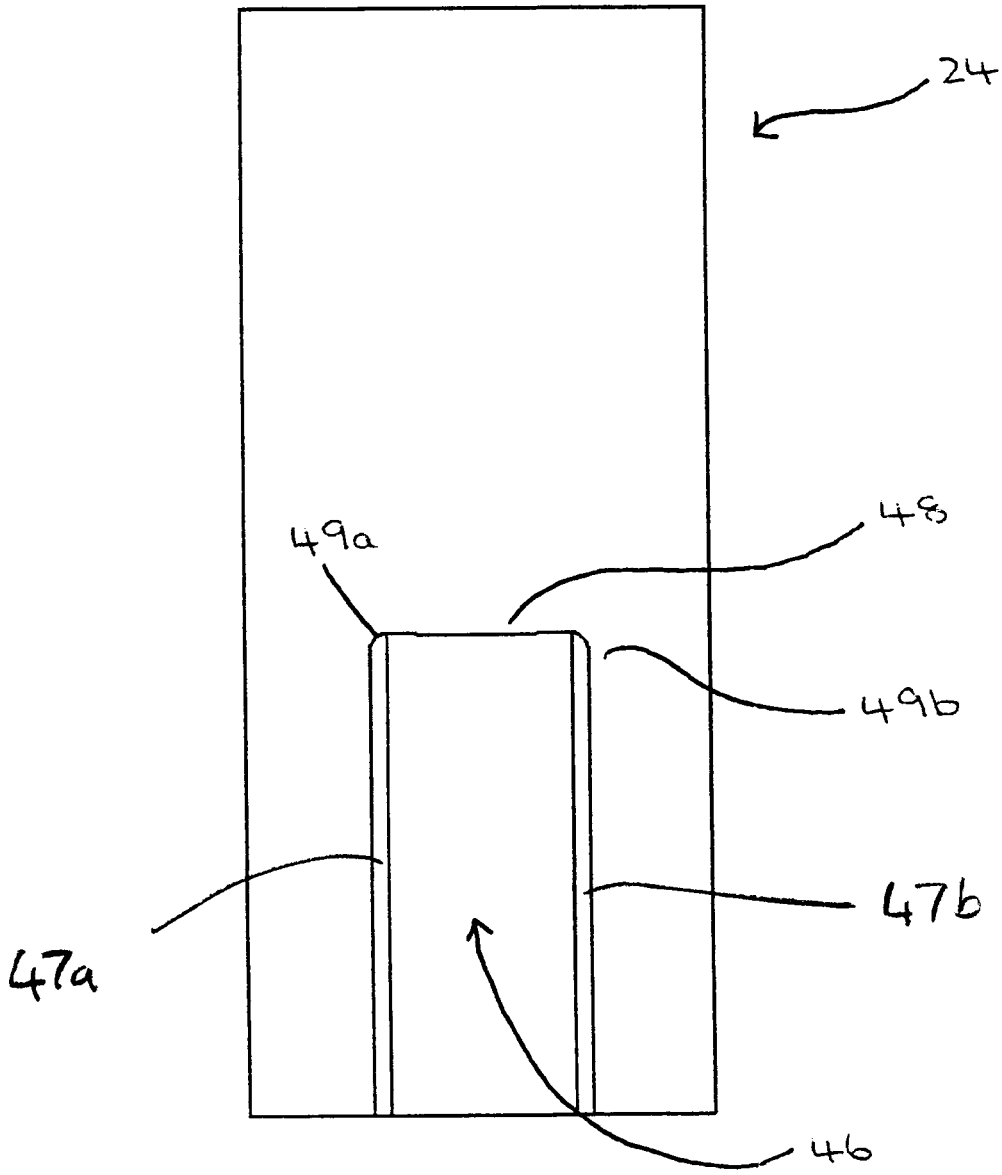

The method described previously may also be used to provide a recess 46 in the metering valve member 24 of the metering valve arrangement, as shown in FIG. 7, wherein the recess 46 has a periphery 48 having two substantially square corners 49*a*, 49*b*. The periphery 48 is also formed with two substantially parallel facing edges 47*a*, 47*b* by virtue of the planar radial surfaces 36, 38 of the grinding wheel (as shown in FIGS. 3 and 4). In this case, the grinding process is continued until a region of the metering valve member 24 is removed to define a recess 46 of the required size. It will be appreciated that the opening of the recess 46 defined in the metering valve member 24 only has two square corners 49*a*, 49*b*, as opposed to the four square corners 41*a*, 41*b*, 41*c*, 41*d* of the recess in the sleeve 10, as the metering valve member 24 is ground at an end region thereof, whereas a central region of sleeve 10 is ground between opposing sleeve ends. In the aforedescribed example, whether the periphery of the opening 16 at the internal bore 12 of the sleeve 10 is an exact square or rectangular in shape will be determined by the diameter of the bore 12 and the extent to which the surface 34 of the wheel 32 is concave.

The present invention provides a convenient method of forming openings of at least partially rectangular or square form in both the metering valve sleeve 10 and the metering valve member 24 of a metering valve arrangement to define ports for a fluid flow. It has been found that advantages are obtained if the outer periphery 48 of the recess 46 in the metering valve member 24 and the outer periphery 42 of the opening 40 in the metering valve sleeve 10 are of generally square or rectangular form, as the sensitivity of the metering valve arrangement is improved.

When the method is used to provide a square or rectangular opening at the internal bore 12 of the metering valve sleeve 10, it will be appreciated that the extent to which the circumferential surface 34 of the grinding wheel 32 should be made concave will be determined by the internal diameter of the bore 12. Likewise, when the method is used to provide a recess 46 in the metering valve member 24 to define an opening having a periphery 48 including two substantially square corners, the extent to which the outer surface 34 of the grinding wheel 32 should be made concave will be determined by the diameter of the cylindrical outer surface of the metering valve member 24. In use, as the grinding wheel 32 grinds away the metering valve sleeve 10, the grinding wheel itself is worn away and therefore needs to be continuously or intermittently reshaped. The circumferential surface 34 of the grinding wheel 32 may be shaped by means of a dresser (not shown) mounted in a conventional manner on the opposite side of the wheel 32 to the sleeve 10. The dimensions of the dresser are chosen to ensure that the extent to which the outer surface 34 of the wheel is shaped concave will give a substantially square or rectangular opening, at the desired surface, for the diameter of the component to be ground.

Figure 8:
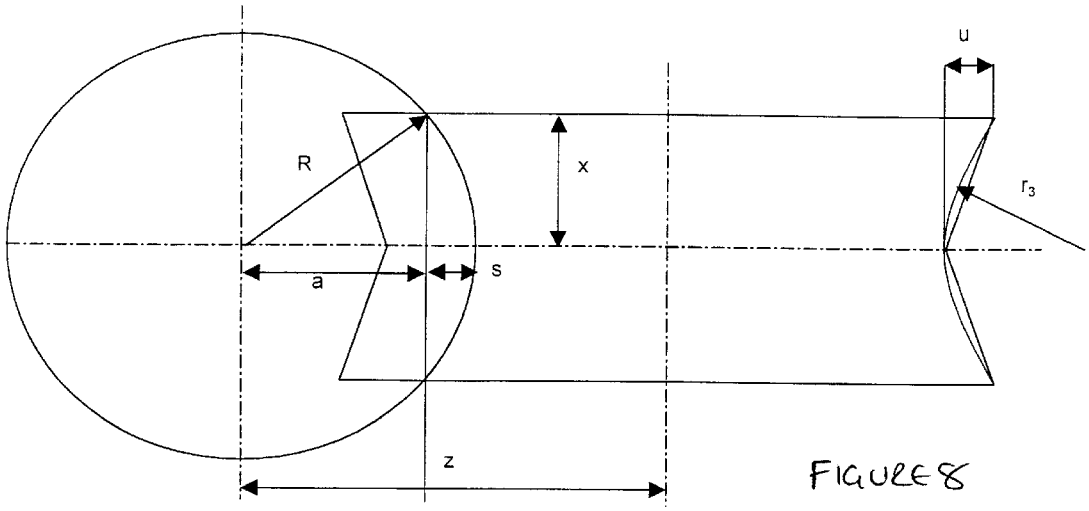
FIG. 8 is a plan view of the metering valve.

FIG. 8 shows a plan view of a metering valve member 24 having a radius, R, in which an opening having an outer periphery of substantially rectangular form is to be formed. The following equations show the relationship between various dimensions of the metering valve member 24 and the grinding wheel 32 identified in FIG. 8. The equations enable a value to be calculated for $r_3$, the radius of the dresser, for a port or opening in the valve member 24 having a width, W, and a height, H.

$$R = \frac{D}{2}$$

$$x = \frac{W}{2}$$

$$y = \frac{H}{2}$$

$$a = \sqrt{R^2 - x^2}$$

$$s = R - a$$

$$b = \sqrt{r1^2 - y^2}$$

$$c = b - s$$

$$r2 = \sqrt{y^2 + c^2}$$

$$z = R + c = a + b$$

$$u = r1 - r2$$

$$r3 = \frac{(x^2 + u^2)}{2u}$$

where a is the centreline distance to the outer diameter of the grinding wheel 32, x is equal to half the port width, W, and z is the distance from the centre of the grinding wheel 32 to the centre of the metering valve member 24.

Figure 9:
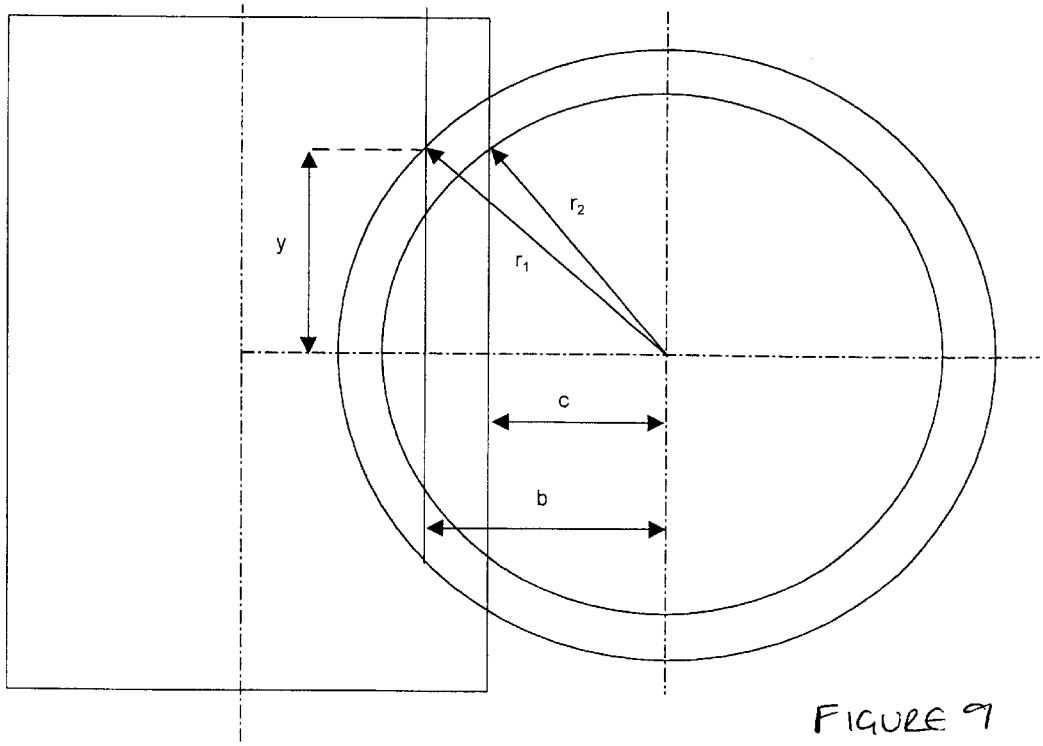
FIG. 9 is a side view of the metering valve.

FIG. 9 shows a side view of the metering valve member 24 and the grinding wheel 32, in which c is depth from the centre axis of the grinding wheel 32 at the centreline, b is the depth from the centre axis of the grinding wheel 32 at its outermost edge, r1 is the radius of the grinding wheel 32 to the edge of the grinding wheel 32, r2 is the radius to the mid-point of the concave outer circumference of the grinding wheel 32 and y is equal to half of the height, H, of the opening 48.

By way of example, typical dimensions (in millimeter) identified in FIG. 8 are as follows; R=3.1775, x=I1.5 (W=3.0), y=6.4 (H=12.8), a=2.8012, $r_1$=15.0, b=13.5661, c=13.1898, $r_2$=14.6605 and z=16.3673. To form a 3.0 (W)× 12.8 (H) nun opening in the metering valve member 24, the radius $r_3$ of the dresser should therefore be 3.4836 mm.

It will be appreciated that the above equations can also be applied to calculate the radius, $r_3$, required for the dresser if a square or rectangular port 42 is to be formed at the inner surface of the bore 12 in the metering valve sleeve 10 (as shown in FIG. 6).

Although the method described previously is described as employing a rotatable grinding wheel or disc 32 for engagement a fixed body 10/24, for some applications removal of the required portion of the body to define the opening may be achieved by any form of relative rotation between the body and the wheel (e.g. by rotating the body 10, 24).

Additionally, although the method described above involves the use of a grinding wheel 32 to remove a portion of a metering valve sleeve 10 or a portion of a metering valve member 24, it will be appreciated that for certain materials is may be more convenient to use a toothed milling wheel instead to remove the required body portion. For example, it may be more appropriate to use a milling wheel if the body within which the opening is provided is formed from a relatively soft material. Any reference to grinding is therefore intended to include processes such as milling, or other similar processes, which rely on relative rotation between engaged parts to create an opening in a body.

The present invention is not limited to use in providing openings of square or rectangular form in metering valve components, but may be applied to any component formed from a metal or any other material suitable for grinding or milling, which includes a region of generally cylindrical form.

Obviously, many modifications and variations of the present invention are possible in light of the above teachings. The invention may be practiced otherwise than as specifically described within the scope of the appended claims.

What is claimed is:

1. A method of forming a recess in a body having an outer surface of substantially cylindrical form, the method comprising:

providing a grinding wheel having a first axis, a circumferential surface concave to a second axis, which is substantially orthogonal to the first axis, and first and second opposing radial surfaces of substantially planar form, engaging at least a portion of the circumferential surface of the grinding wheel with the outer surface of the body; and rotating at least one of the grinding wheel and the body relative to the other to cause a region of the body to be ground by said wheel, thereby to define a recess in the body having a periphery at the outer cylindrical surface thereof, said periphery having at least two substantially square corners, first and second substantially parallel facing edges extending from the two substantially square corners, the two substantially square corners being joined by a third straight edge.

2. The method as claimed in claim 1, including rotating the grinding wheel about the first axis to provide said relative rotation between the grinding wheel and the body.

3. The method as claimed in claim 2, wherein the body takes the form of a metering valve member having a substantially cylindrical outer surface.

4. The method as claimed in claim 3, the metering valve member having an end region, the extending to an end surface of the end region.

5. The method as claimed in claim 1, wherein the axis of the body is arranged to be substantially perpendicular to the first axis of the grinding wheel.

6. A method of forming a recess in a body provided with an internal bore to define a tubular wall having a cylindrical internal surface, the method comprising:

providing a grinding wheel having a first axis, a circumferential surface concave to a second axis, which is substantially orthogonal to the first axis, and first and second opposing radial surfaces of substantially planar form;

engaging at least a portion of the circumferential surface of the grinding wheel with an outer surface of the body; and rotating at least one of the grinding wheel and the body so that they move relative to one another to cause a region of the body to be ground by said wheel, thereby to define an opening which extends through the tubular wall, said opening having a periphery at the cylindrical internal surface of the body, wherein said periphery includes at least two substantially square corners and at least one pair of substantially parallel facing edges.

7. The method as claimed in claim 6, including rotating the grinding wheel about the first axis to provide said relative rotation between the grinding wheel and the body.

8. The method as claimed in claim 7, wherein the circumferential surface of the grinding wheel is shaped such that the opening defined in the tubular wall has a periphery at the internal surface of the wall that includes at least two substantially square corners.

9. The method as claimed in claim 8, comprising grinding a region of the body intermediate opposing end regions of the body to define an opening having a periphery at the internal surface of the tubular wall having four substantially square corners.

10. The method as claimed in claim 8, wherein the body takes the form of a metering valve sleeve for a metering valve member.

11. The method as claimed in claim 10, wherein the periphery of the opening in the metering valve sleeve is substantially square.

12. The method as claimed in claim 10, wherein the periphery of the opening in the metering valve sleeve is substantially rectangular.

13. A method of forming a recess in a metering valve member having and and an outer surface of substantially cylindrical form, the method comprising:

providing a grinding wheel having a first axis, a circumferential surface concave to a second axis, which is substantially orthogonal to the first axis, and first and second opposing radial surfaces of substantially planar form;

engaging at least a portion of the circumferential surface of the grinding wheel with the outer surface of the metering valve member; and rotating at least one of the grinding wheel and the body so that they move relative to one another to cause an end region of the metering valve member to be ground by said wheel so as to define a recess which extends to an end surface of the metering valve member, said recess having a periphery at the outer cylindrical surface of the metering valve member which has a pair of substantially parallel facing edges and two substantially square corners joined by a third straight edge.

14. A method of forming a recess in a body having at least one surface substantially cylindrical form, the surface having a first radius, the recess having a periphery on the surface having at least two substantially square corners and first and second substantially parallel facing edges extending from the two substantially square corners, the method comprising:

providing a grinding wheel having a first axis, a circumferential surface concave to a second axis substantially orthogonal to the first axis, and first and second opposing radial surfaces of substantially planar form, the circumferential surface;

determining a second radius as a function of the first radius;

providing a circumferential surface, associated with the second radius, on the grinding wheel; and, forming a recess in the body using the grinding wheel, the second radius determined as a function of the first radius to form a straight edge on the periphery, the two substantially square corners being joined by the straight edge.

15. A method, as set forth in claim 14, wherein the surface is an outer surface of the body.

16. A method, as set forth in claim 14, wherein the body includes a bore, the recess defining an opening through the body to the bore, the surface being an inner surface of the bore.

* * * * *